United States Patent [19]

Miller

[11] Patent Number: 4,735,594

[45] Date of Patent: Apr. 5, 1988

[54] COIN DISPENSING DEVICE

[76] Inventor: Ogden L. Miller, 282 E. U.S. 12, Chesterton, Ind. 46304

[21] Appl. No.: 945,024

[22] Filed: Dec. 22, 1986

[51] Int. Cl.[4] ..... G07D 1/00

[52] U.S. Cl. ..... 453/49; 221/24; 221/89; 124/50; 453/63

[58] Field of Search ..... 221/24, 25, 89–91, 221/197, 198; 453/18, 29, 39, 63, 49; 194/343; 206/0.81, 0.83, 0.84, 534, 538; 124/47, 49, 50

[56] References Cited

U.S. PATENT DOCUMENTS

| | | | |
|---|---|---|---|
| 497,059 | 5/1893 | Ramey | 221/24 X |
| 632,526 | 9/1899 | Hervey | 124/50 X |
| 1,750,215 | 3/1930 | Dwyer | 206/0.81 |
| 2,766,763 | 10/1956 | Shough | 453/49 |
| 2,853,083 | 9/1958 | Roedelheimer et al. | 453/63 X |
| 2,986,148 | 5/1961 | Vogl | 453/37 |
| 3,191,588 | 6/1965 | Thew | 221/281 X |
| 3,241,541 | 3/1966 | Coffey | 124/49 |
| 3,487,824 | 1/1970 | Profitt . | |
| 3,515,114 | 6/1970 | Carbonneau . | |
| 3,787,052 | 1/1974 | Glass et al. | 221/197 X |

FOREIGN PATENT DOCUMENTS

| | | | |
|---|---|---|---|
| 614825 | 2/1961 | Canada | 453/49 |

*Primary Examiner*—F. J. Bartuska

*Attorney, Agent, or Firm*—Norman B. Rainer

[57] ABSTRACT

A device for dispensing coins into highway toll collection baskets has the general configuration of a hand gun having a barrel, handle and trigger mechanism. When the trigger is pulled rearwardly, coins predisposed in separate compartments within the bore of the barrel are released for downward rolling movement toward the open forward extremity of the bore.

5 Claims, 2 Drawing Sheets

COIN DISPENSING DEVICE

BACKGROUND OF THE INVENTION

This invention relates to a device for dispensing coins, and more particularly concerns a device adapted to direct controlled amounts of coins into a toll basket at toll-paying stations on highways.

On many of the toll highways throughout the United States, special toll gates are provided for motorists who have the exact coin or combination of coins for the payment of the toll due, in order to facilitate toll payment and to save the cost of an attendant at that gate. At such toll gates, baskets with screen bottoms are provided into which the motorist throws the coin in payment of the toll, a procedure he may carry out by merely slowing down without stopping or waiting.

The accurate throwing of the coin in payment of the toll, however, is difficult for many people and frequently results in the misdirection of the coin, so that it falls to the ground, requiring an embarrassing stop and delay to search for and pick up the coin and deposit it. This is due, mainly, to the fact that toll payments are generally made to the left of the drivers, who are generally right handed and find it difficult to throw accurately with their left hand. Also, the left hand of a driver is generally confined against the side of the vehicle and not convenient to manage.

Further, the payment of tolls, in general, frequently requires the fumbling and fishing about in pocket or purse for the requisite coinage; a further delaying procedure. When the vehicle window adjacent the driver is rolled down to its open position in preparation for throwing the coins, conditioned air within the vehicle is lost, the amount of said lost conditioned air being dependent upon the extent to which the window is rolled down and the length of time the window is kept open.

U.S. Pat. No. 2,986,148 discloses a device for dispensing coins at toll stations, said device requiring installation upon the exterior of the vehicle and lacking sufficient manipulative versatility to function with differently placed toll collection baskets.

U.S. Pat. No. 3,191,588 discloses a hand held coin-ejecting gun. Although convenient to use, the gun is of expensive construction and limited to just one coin type.

It is accordingly an object of the present invention to provide a hand-held device for accurately dispensing coins into the collection basket of a highway toll station.

It is another object of this invention to provide a device as in the foregoing object capable of handling a variety of coins and having manipulative versatility.

It is a still another object of the present invention to provide a device of the aforesaid nature capable of easy operation and amenable to low cost manufacture.

These objects and other objects and advantages of the invention will be apparent from the following description.

SUMMARY OF THE INVENTION

The above and other benefical objects and advantages are accomplished in accordance with the present invention by a coin dispensing device having the general configuration of a hand gun comprising:

(a) a gripping handle having upper, lower, forward and rearward extremities, and an internal cavity, (b) an elongated barrel attached to the upper extremity of said gripping handle in a manner achieving the general appearance of a hand gun, said barrel being comprised of:

(1) parallel upper and lower panels, (2) a pair of side panels in parallel disposition extending between said upper and lower panels in joinder therewith, (3) front and rear extremities, (4) an internal bore defined by the interiorly directed surfaces of said panels, said bore opening upon said front-extremity and sealed at said rear extremity, and having a substantially uniform rectangular configuration extending the length of the barrel, said rectangular configuration having a height, measured between upper and lower panels about twice its width, measured between the side panels, (5) a series of observation apertures in both side panels adjacent said rear extremity, and (6) a slotted trigger-accommodating aperture disposed in said bottom panel adjacent said gripping handle, (c) a trigger mechanism comprised of a flat lever pivotably attached to said side panels and having a straight upper edge that extends through said trigger-accommodating aperture and into said bore and a forward edge disposed below said barrel and forward of said handle, and a resilient member disposed within the internal cavity of said handle and in abutment with said lever to urge said forward edge forwardly, whereby when said forward edge is pulled rearwardly against the urging of said resilient member, said straight upper edge is moved into coplanar relationship with the interiorly directly surface of said lower panel, and (d) retainer plates pivotably associated with one of said side panels and disposed between said observation apertures in a manner to controllably occlude the bore.

In a preferred embodiment of the device, a cartridge having separate coin-holding compartments is slideably associated with the exterior surface of the upper panel of the barrel. The position of the cartridge along the upper panel is controlled by a locking catch, preferably on the cartridge, which sequentially engages a series of holding apertures on the barrel. A coin-receiving slot, positioned in said upper panel, enables coins to fall from the cartridge into the bore at a site where their movement within the bore is controlled by said trigger mechanism.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

Figure 3:
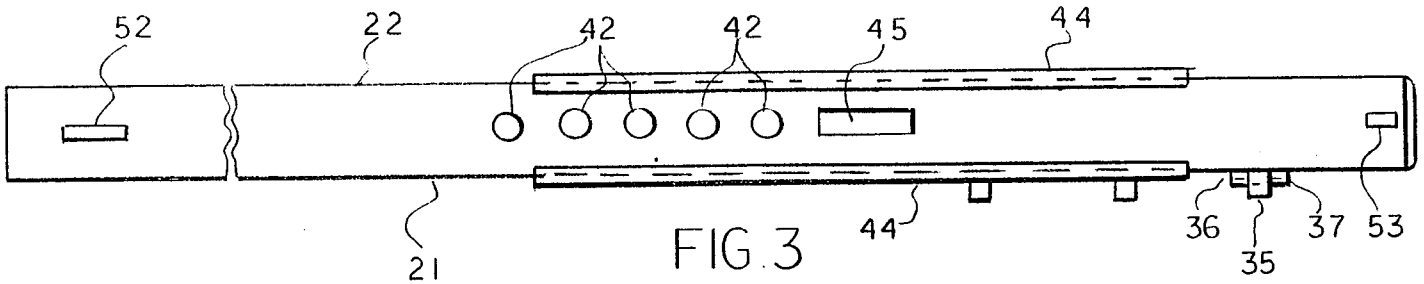
FIG. 3 is a top view of the device shown in FIG. 1.
Figure 1:
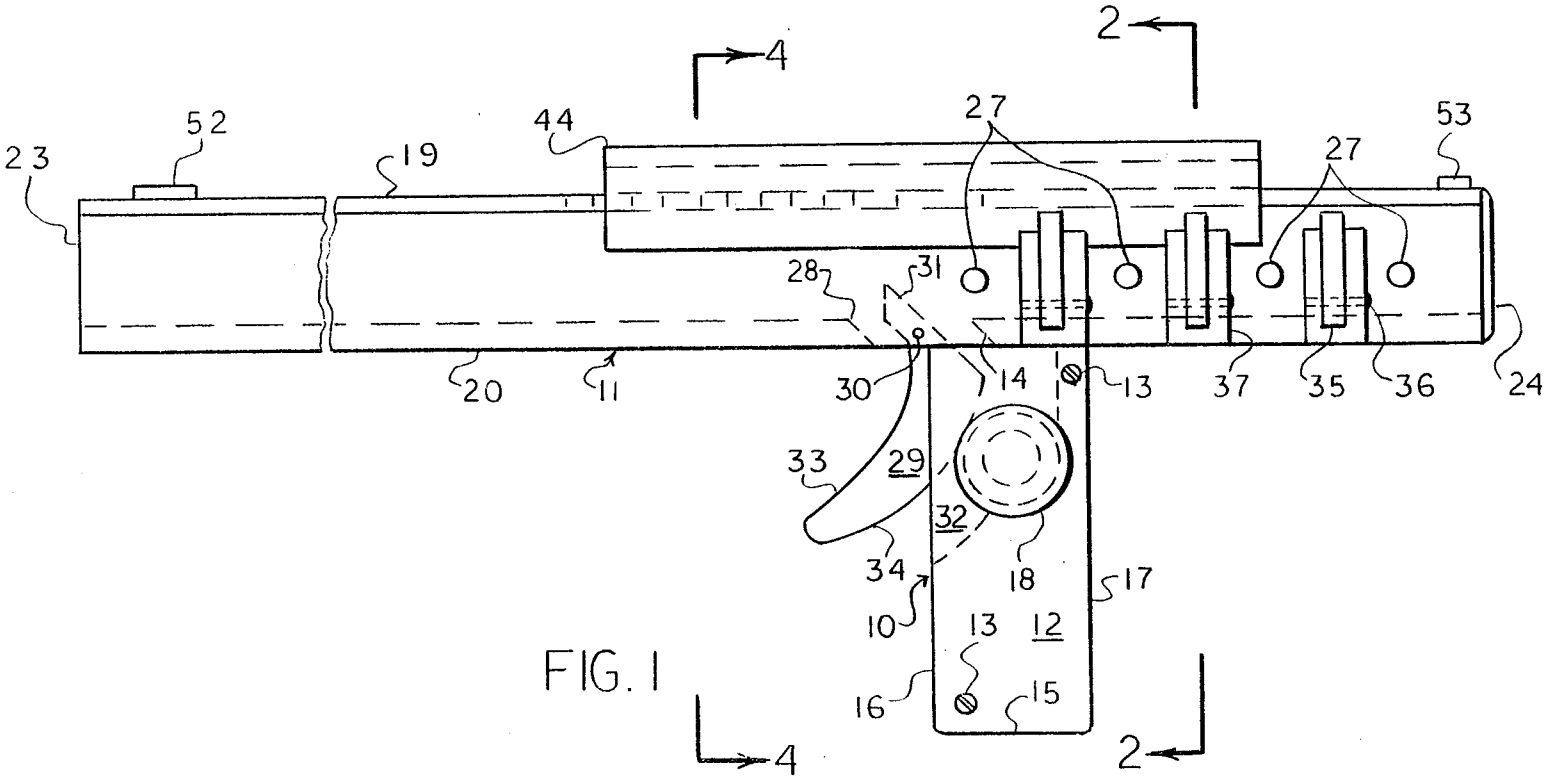
FIG. 1 is a side elevational view of an embodiment of the device of this invention.
Figures 2, 4, 5, 6, 7:
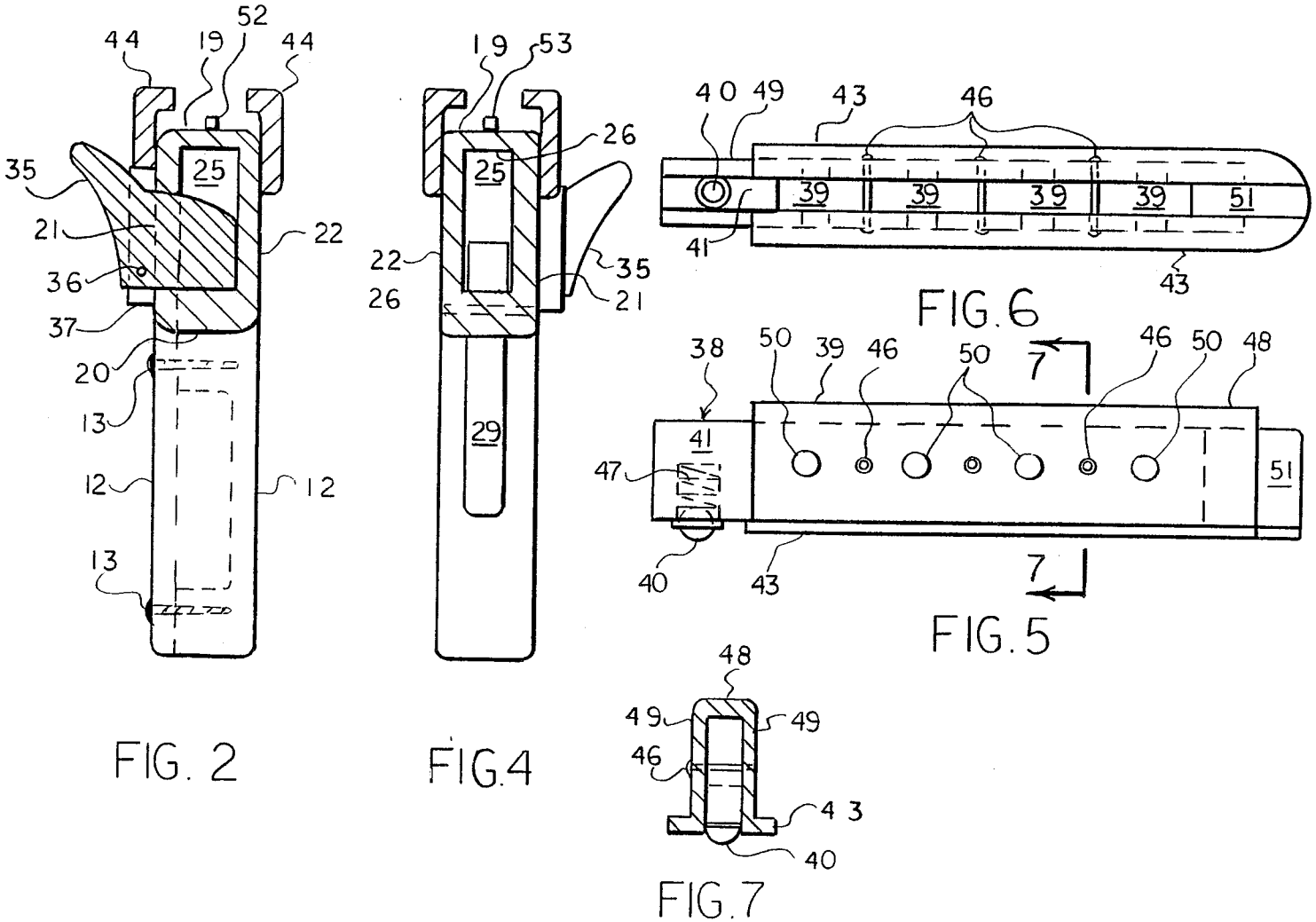
FIG. 2 is a sectional end view taken along the line 2—2 of FIG. 1.
FIG. 4 is a sectional end view taken along the line 4—4 of FIG. 1.
FIG. 5 is a side elevational view of a cartridge useful with the device of FIG. 1.
FIG. 6 is a bottom view of the cartridge of FIG. 5.
FIG. 7 is a sectional view taken along the line 7—7 of FIG. 5.

The terms "forward" and "rearward" and other terms of equivalent import will have reference to the left and right extremities, respectively, of the device illustrated in FIG. 1. Similarly, the expressions "upper" and "lower" and equivalent terms will have reference to the upper and lower extremities, respectively, of the device shown in FIG. 1.

DESCRIPTION OF THE PREFERRED EMBODIMENT

Referring to FIGS. 1–4, a coin handling device of this device is shown having a gun-like appearance comprised of gripping handle 10 and elongated barrel 11.

The gripping handle is comprised of two rectangular side plates 12, one of which is an integral extension of barrel 11, and the other secured thereto in parallel spaced apart relationship by screws 13, and defining upper, lower, forward and rear extremities 14, 15, 16 and 17, respectively. A resilient circular ring 18 is held within the internal cavity 32 defined by said side plates, said ring being part of a trigger mechanism, as will hereafter be shown.

The barrel is attached to the upper extremity of the handle in a manner to achieve the general appearance of a hand gun. The barrel has a generally rectangular cross sectional configuration formed by parallel upper and lower panels 19 and 20, respectively, and left and right side panels 21 and 22, respectively, extending in parallel disposition between said upper and lower panels and joining therewith to form a rectangular outer periphery. The barrel terminates at front and rear extremities 23 and 24, respectively. The barrel may be fabricated of rigid durable material such as wood, metal or plastic. If comprised of plastic, the structure may be fabricated by injection molding techniques. A sighting stub 52 may be positioned upon panel 19 at its forward extremity.

An internal bore 25 is defined by the interiorly directed surfaces of said panels, said bore opening upon said front extremity and being sealed at said rear extremity. The bore has a substantially uniform rectangular configuration extending the length of the barrel. The height of the bore, measured between the interior surfaces 26 of the upper and lower panels, is about twice the width of the bore, said width being measured between the interiorly directed surfaces of the side panels.

A series of observation apertures 27 is disposed in left and right side panels 21 and 22 adjacent the rear extremity of the barrel and disposed along a straight line path parallel to the upper panel. The purpose of the apertures is to permit visual detection of the presence of coins disposed within the bore.

A slotted trigger-accommodating aperture 28 is disposed within the bottom panel adjacent the gripping handle. A trigger mechanism is associated with said handle and barrel, said mechanism being comprised of a flat lever 29 attached by pivot pin 30 to said side panels and centered within a plane that bisects the barrel and handle and includes the axis of elongation of the barrel. The lever 29 has a straight upper edge 31 extending through aperture 28 and communicating between the bore and cavity 32, and has a curved forward edge 33 disposed below the barrel and forward of the handle. A rear edge 34, convexly curved in the rearward direction, contacts resilient ring 18 in a manner whereby forward edge 33 is urged forwardly. In operation, when no force is applied to forward edge 33 to move it rearwardly against the urging of the resilient ring, upper edge 31 blocks bore 25, thereby preventing any coins that may be housed within the rearward portion of the bore from rolling forward within the bore toward open front extremity 23. When finger-applied force moves the forward edge 33 rearwardly, upper edge 31 becomes coplanar with interior surface 26 of lower panel 20, thereby enabling coins to freely roll forward within the bore upon said lower panel.

Retainer plates 35, joined by pivot pins 36 to holding blocks 37 attached to left side panel 21, are adapted to controllably enter the bore in a direction perpendicularly disposed to the axis of elongation. When entered into the bore, the retainer plate serves to block passage of coins within the bore. The distance between two adjacent plates defines a holding chamber within the bore equipped with observation apertures.

The dispenser device is loaded by entering coins through slotted aperture 45 in panel 19 while holding the barrel with the front extremity upwardly directed, and the retainer plates in their open positions. An amount of coins suitable for a toll are entered into the bore and allowed roll to rest at rear extremity 24. The retainer plate closest rear extremity 24 is then caused to block the bore. The process is then repeated, whereby the coins come to rest in abutment with the retainer plate, and the next forwardly successive retainer plate is subsequently closed. The forwardmost coin-holding compartment is bounded by upper edge 31 of the trigger, and the forwardmost retainer plate.

When it is desired to dispense the coins, the barrel is pointed downwardly with front extremity 23 positioned above the toll collection basket. The trigger is squeezed, and the confined coins roll downwardly into the basket. In a subsequent dispensation of coins, the next retainer plate is pivoted out of its bore-blocking position. The barrel may be extended, if desired, by attaching to front extremity 23 an additional length having the same bore dimensions.

A cartridge 38 may be slideably positioned atop upper panel 19. The cartridge is constructed in part from an integral molded component having upper wall 48, opposed side walls 49, opposed flanges 43 extending outwardly from the bottom of side walls 49, and front and rear closure blocks 41 and 51, respectively, positioned between said sidewalls. Spaced apart viewing apertures 50 and escutcheon pins 46 penetrate sidewalls 49. By virtue of such construction, several compartments 39 are defined having open bottoms. A detent ball 40, located within closure block 41, is urged downwardly below said block by spring 47. Said detent ball is adapted to controllably engage a holding aperture 42 of the series of holding apertures linearly disposed within upper panel 19 of the barrel. Flanges 43 are adapted to engage paired holding brackets 44 atop the barrel. When utilized, the cartridge makes close-fitting sliding contact with upper panel 19 which serves to temporarily close compartments 39 of the cartridge. As the compartments of the cartridge move rearwardly upon the barrel, coins confined within said compartments drop downwardly through slotted aperture 45 in panel 19, arriving in the bore at a site behind the trigger. In such manner, additional coins of varied denomination and mixture may be added to the gun for controlled discharge. An abutment stub 53, positioned at the rearward extremity of panel 19, prevents the cartridge from sliding too far rearwardly.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described my invention, what is claimed is:

1. A coin dispensing device having the general configuration of a hand gun comprising:

(a) a gripping handle having upper, lower, forward and rearward extremities, and an internal cavity, (b) an elongated barrel attached to the upper extremity of said gripping handle in a manner achieving the general appearance of a hand gun, said barrel being comprised of:

(1) parallel upper and lower panels, (2) a pair of side panels in parallel disposition extending between said upper and lower panels in joinder therewith, (3) front and rear extremities, (4) an internal bore defined by the interiorly directed surfaces of said panels, said bore opening upon said front-extremity and sealed at said rear extremity, and having a substantially uniform rectangular configuration extending the length of the barrel, said rectangular configuration having a height, measured between upper and lower panels about twice its width, measured between the side panels, (5) a series of observation apertures in both side panels adjacent said rear extremity, and (6) a slotted trigger-accommodating aperture disposed in said bottom panel adjacent said gripping handle, (c) a trigger mechanism comprised of a flat lever pivotably attached to said side panels and having a straight upper edge that extends through said trigger-accommodating aperture and into said bore and a forward edge disposed below said barrel and forward of said handle, and a resilient member disposed within the internal cavity of said handle and in abutment with said lever to urge said forward edge forwardly, whereby when said forward edge is pulled rearwardly against the urging of said resilient member, said straight upper edge is moved into coplanar relationship with the interiorly directed surface of said lower panel, and (d) retainer plates pivotably associated with one of said side panels and disposed between said observation apertures in a manner to controllably occlude the bore.

2. The coin dispensing device of claim 1 further provided with a cartridge having separate coin-holding compartments.

3. The coin dispensing device of claim 2 wherein said cartridge slideably engages the exterior surface of the upper panel of the barrel.

4. The coin dispensing device of claim 3 wherein the position of the cartridge along said upper panel is controlled by a locking catch on the cartridge which sequentially engages a series of holding apertures in said upper panel.

5. The coin dispensing device of claim 3 wherein a coin-receiving slot, positioned in said upper panel, enables coins to fall from the cartridge into the bore at a site where their movement within the bore is controlled by said trigger mechanism.

* * * * *